United States Patent [19]

Mize

[11] Patent Number: 4,778,347

[45] Date of Patent: Oct. 18, 1988

[54] HIGH PRODUCTION PUMP FOR VISCOUS MATERIALS AND METHOD

[76] Inventor: Robert L. Mize, 534 Motorboat Club Rd., Greenville, S.C. 29611

[21] Appl. No.: 906,898

[22] Filed: Sep. 15, 1986

[51] Int. Cl.[4] ..... F04B 21/02; F04B 21/04

[52] U.S. Cl. ..... 417/53; 417/238; 417/454; 417/568; 92/59; 92/194; 92/240; 29/221.6

[58] Field of Search ..... 417/568, 454, 238, 274, 417/53; 92/60.5, 128, 240, 244, 245, 247, 59, 194; 29/213 R, 213 E

[56] References Cited

U.S. PATENT DOCUMENTS

| | | | |
|---|---|---|---|
| 865,151 | 9/1907 | Andrew | 417/568 X |
| 1,977,075 | 10/1934 | Magnuson | 92/240 |
| 2,254,026 | 8/1941 | Berry | 92/240 |
| 2,432,671 | 12/1947 | Longenecker | 417/238 |
| 2,861,329 | 11/1958 | Bishman | 29/213 E |
| 2,961,278 | 11/1960 | Newhall | 92/247 X |
| 2,977,167 | 3/1961 | Barnhart | 92/247 X |
| 3,092,427 | 6/1963 | Sadler et al. | 92/240 X |
| 3,603,215 | 9/1971 | Leschisin | 92/240 X |

FOREIGN PATENT DOCUMENTS

| | | | |
|---|---|---|---|
| 513393 | 2/1955 | Italy | 417/568 |
| 918078 | 4/1982 | U.S.S.R. | 29/213 E |
| 790795 | 2/1958 | United Kingdom | 92/244 |

*Primary Examiner*—Carlton R. Croyle
*Assistant Examiner*—Paul F. Neils
*Attorney, Agent, or Firm*—Cort Flint

[57] ABSTRACT

Apparatus and method of improving the performance of a pump for pumping fireproofing material and the like viscous materials is disclosed wherein the pump is the type which includes a compression chamber (44) having an inlet (48) and an outlet (50). A piston cylinder (19) is disposed in fluid communication with the compression chamber and, a piston assembly (A, D, G) is carried in the piston cylinder driven in reciprocating suction and compression strokes. The piston assembly includes an extended piston (B,E) carried on a push rod (18) having a piston face (42, 61) terminating adjacent an inlet ball limit pin (52), having a reduced pin length of 5/16 inch, at the end of the compression stroke. The piston is further provided in a form having downwardly angled contoured surface (38,60) extending from a cylindrical surface (40, 62) to the piston face wherein the contoured surface is formed in a manner that clearance exists between the piston and an inlet ball valve (48*a*) at the end of the compression stroke so that the full extent of the piston may be had into the compression chamber. The piston assembly further includes a piston cup (26) constructed from a polymeric material having a cylindrical base (26*a*) with an outer diameter less than an inner diameter of the piston cylinder (19). A cylindrical wall (26) extends from the cylindrical base having an outer diameter greater than the outer diameter of the cylindrical base for sealingly engaging the piston cylinder wall.

24 Claims, 5 Drawing Sheets

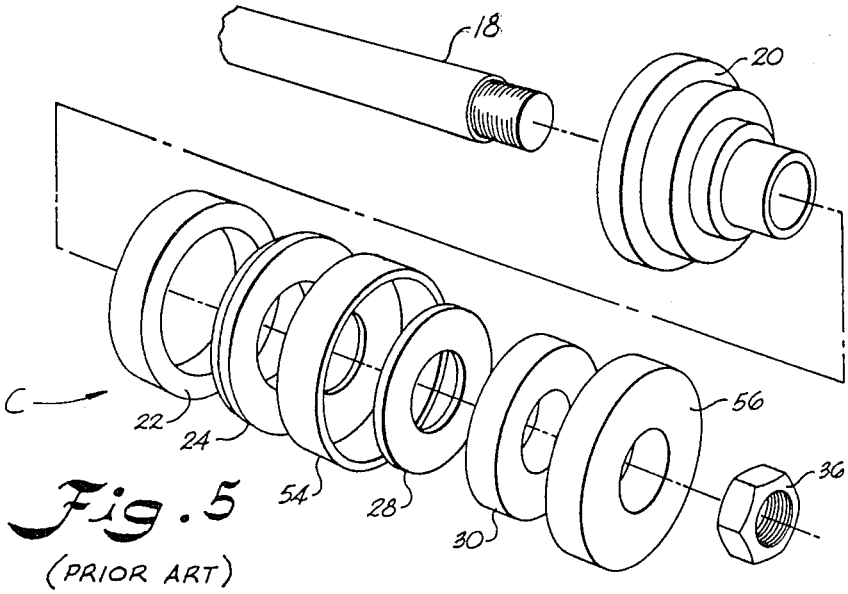
Fig. 5
(PRIOR ART)
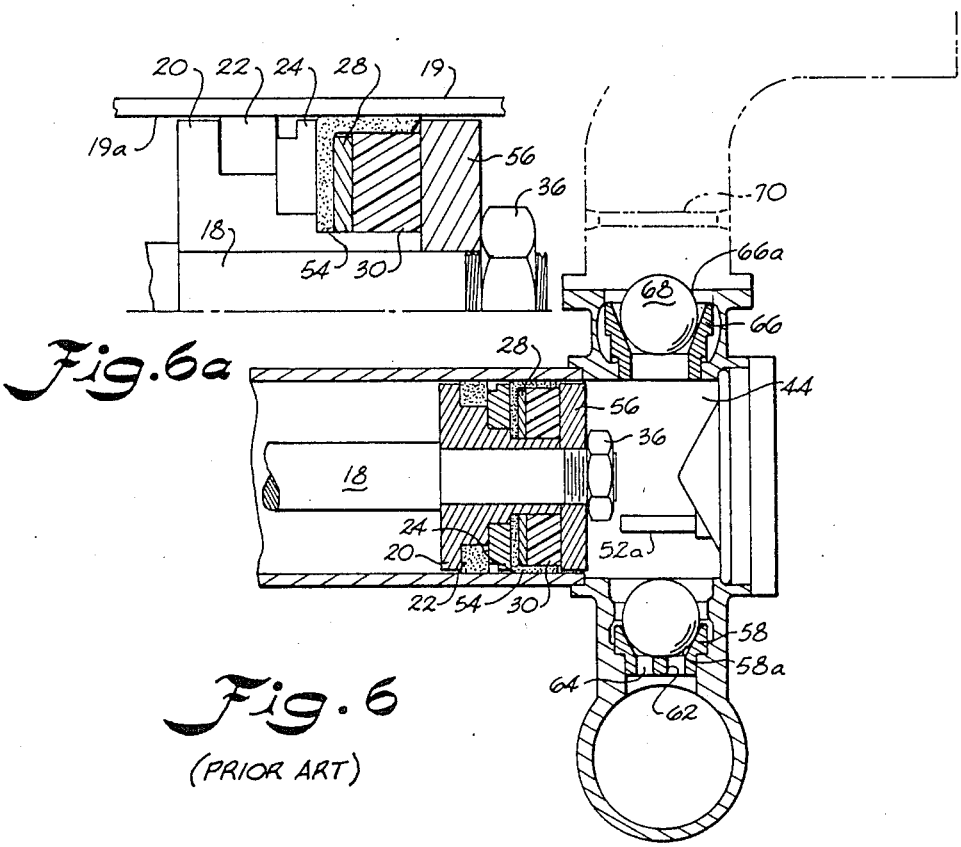
Fig. 6a
Fig. 6
(PRIOR ART)

HIGH PRODUCTION PUMP FOR VISCOUS MATERIALS AND METHOD

BACKGROUND OF THE INVENTION

The invention relates to the pumping of viscous materials such as plaster, slurry, and fireproofing materials. Particularly, the invention relates to improvements in pumps of this type which allow for higher production, particularly in the pumping of fireproofing materials such as Monokote spray applied fireproofing material manufactured by the W. R. Grace, Company which is a cementitious (plaster) material requiring only the addition of water on the job. Typically, such materials include ninety to ninety-six percent Gypsum binder and aggregate with fiberglass, fillers, and air entraining agents in small amounts. These materials are highly spongy in a pumping state undergoing pumping. Due to the spongy nature of the material, it is difficult, if not impossible, to pump all of the material out of the pump chamber. Some of the material must be used to compress the material that is pumped, all of which cause the prior pumps utilized to pump such viscous materials rather ineffecient.

Most of the pumps utilized to pump the viscous fireproofing materials are plaster type pumps which were developed to pump a more stable compressible material. These pumps are not very efficient for pumping light weight, spongy materials which are normally used as fireproofing materials. In particular, a problem of dead air spaces exist in the use of plaster type pumps for pumping spongy fireproofing material. On the suction stroke, a blow by of air may occur past the piston assembly which creates an air pocket on the compression chamber side of the piston, all of which reduce the volume of material pumped.

In particular, the invention is directed to improvements in a model TM 30 plaster pump manufactured by the Essick Manufacturing Company of Los Angeles, Calif. and to increasing the production of this pump when used for pumping viscous fireproofing materials, particularly of a spongy nature.

Other typical plaster pumps and pumps for viscous materials are disclosed in U.S. Pat. Nos. 4,521,163; 2,432,671; and 2,146,709.

Accordingly, an object of the invention is to increase the efficiency and production of a plaster pump for pumping spongy fireproofing materials and the like.

Another object of the invention is to provide improvements to a pump for viscous material in which the suction and compression strokes are increased in their capacity.

Another object of the invention is to provide improvements which allow for pumping of soft, spongy fireproofing materials in plaster type pumps with increased production by eliminating restrictive passages and increasing the suction and compression capacities of the pump.

Another object of the present invention is to provide an improved piston assembly for a pump for pumping viscous materials which improves the sealing between the piston assembly and the piston cylinder wall as well as increasing the compression, wear, resistance, and pumping efficiency of the piston assembly.

Yet another object of the invention is to provide an improved pump for pumping viscous materials in which the need for down time of the pump is considerably reduced.

SUMMARY OF THE INVENTION

The above objectives are accomplished according to the present invention by providing in a plaster type pump of the aforementioned type an unrestricted inlet valve, an extended piston, and a piston assembly having improved sealing and wear characteristics. In the conventional plaster type pump manufactured by Essick Manufacturing Company, operating at about six hundred and eighty-five pounds per square inch (685 p.s.i.) in the pump outlet, it has been found that about sixty-six bags of material may be pumped per hour. This is at full throttle and high gear conditions. According to the method and apparatus of the present invention, the pump pressure has been increased to about eight hundred and fifteen pounds per square inch (815 p.s.i.) at the pump outlet producing about seventy-seven bags per hour but at a throttle setting of two-thirds and in a low gear which is about half of the standard revolutions per minute (r.p.m.).

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 5 is a perspective view of parts of a prior art piston assembly separated;

FIG. 6 is a sectional view illustrating a compression chamber and cylinder for a prior art pump;

FIG. 6*a* is an enlarged partial sectional view of FIG. 6.

DESCRIPTION OF A PREFERRED EMBODIMENT

Figure 1:
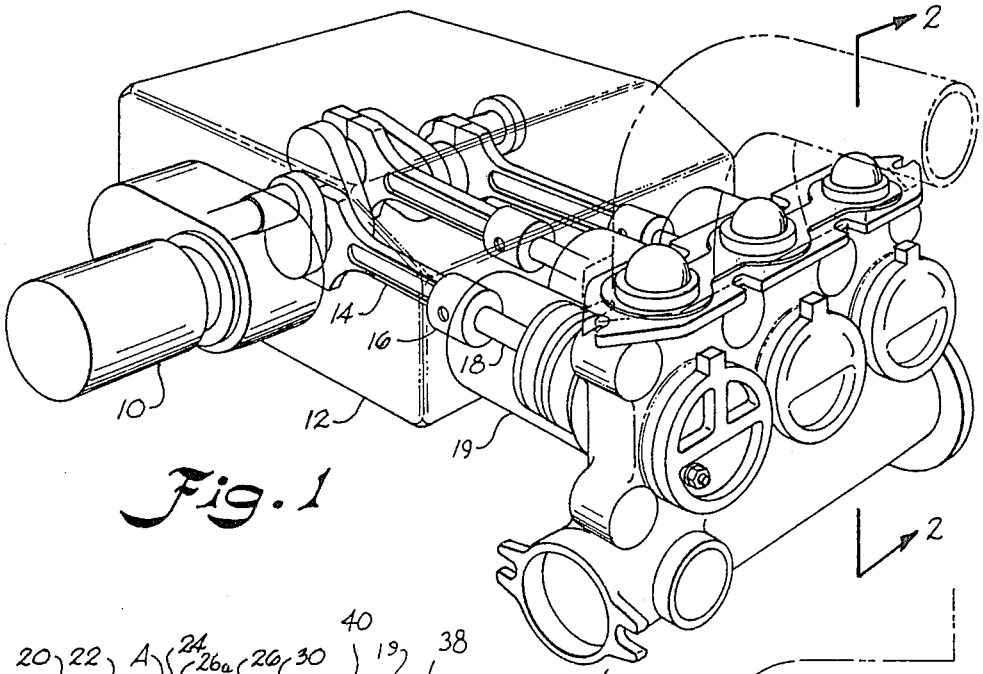
FIG. 1 is a perspective view of a plaster pump of the type improved in accordance with the invention.

Referring now in more detail to the drawings, a plaster pump of the Essick Model TM 30 type is illustrated in FIG. 1 containing improvements made in accordance with the method and apparatus of the present invention.

The pump includes a crank shaft motor 10, a crank shaft housing 12 in which a plurality of piston rods 14 are housed. A wrist pin 16 connects the piston rod 14 to a piston assembly push rod 18. A piston assembly, denoted generally as A, is illustrated and attached to the push rod 18. Piston assembly A is carried in piston cylinder 19.

The piston assembly A includes a rear plate 20, a felt ring 22 carried against the rear plate, and a brass ring 24 carried by the rear plate next to felt ring 22. There is a cup member 26 carried next to brass ring 24 made from a suitable polymeric material such as polyurethane. Within cup member 26 is an intermediate plate 28 and a rubber gromet or ring 30. Next to rubber ring 30 is an extended-light weight piston B constructed from a suitable high-molecular weight polymeric material such as polycarbonate.

Plate 20 abuts against a shoulder **18*a* formed on push rod 18. A threaded end 18*b* of the push rod extends through an opening 32 in piston B formed in a cavity 34 which is dimensioned to receive a nut 36 for fastening the piston assembly together. The diameter of cavity 34 is sufficient to allow a socket to be placed on nut 36 for tightening of the assembly together. Yet the opening of cavity 34** is not large enough for the spongy material to occupy and affect pumping capability.

Referring in more detail to piston B, it will be noted that the piston includes a contoured beveled leading edge 38 which tapers inwardly from a cylindrical surface 40. Beveled edge 38 terminates at a front piston face 42 defined around the opening of cavity 34. Piston B is made to extend into compression chamber 44 in a manner that pumping capacity is increased as will be more fully apparent hereinafter.

The cylindrical base of piston cup 26 has an outside diameter less than the inside diameter of piston cylinder 19. Cylinder wall **26*c* has a larger outside diameter at its outer edge than the inside diameter of piston cylinder 19**. This facilitates sealing action.

Figure 2A:
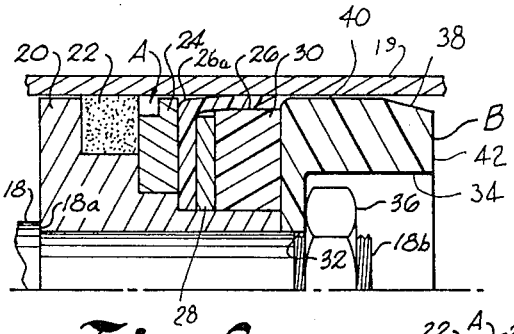
FIG. 2*a* is an enlarged partial sectional view of FIG. 2.
Figure 2:
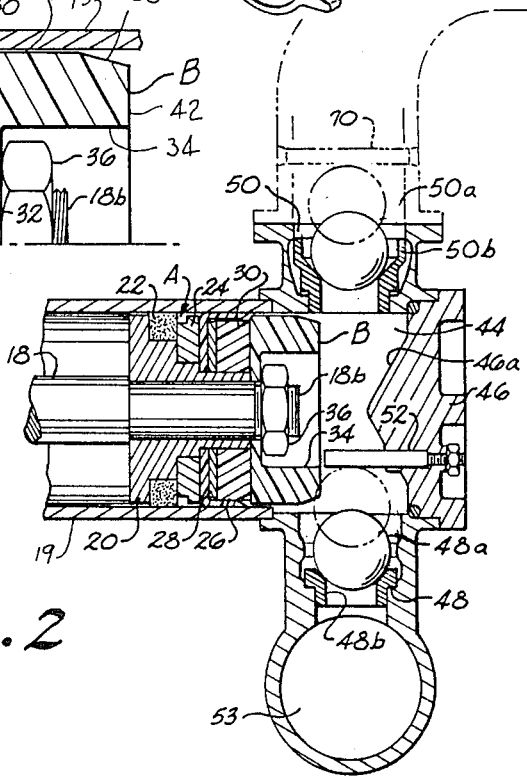
FIG. 2 is a sectional view taken line 2—2 of FIG. 1.
Figure 3:
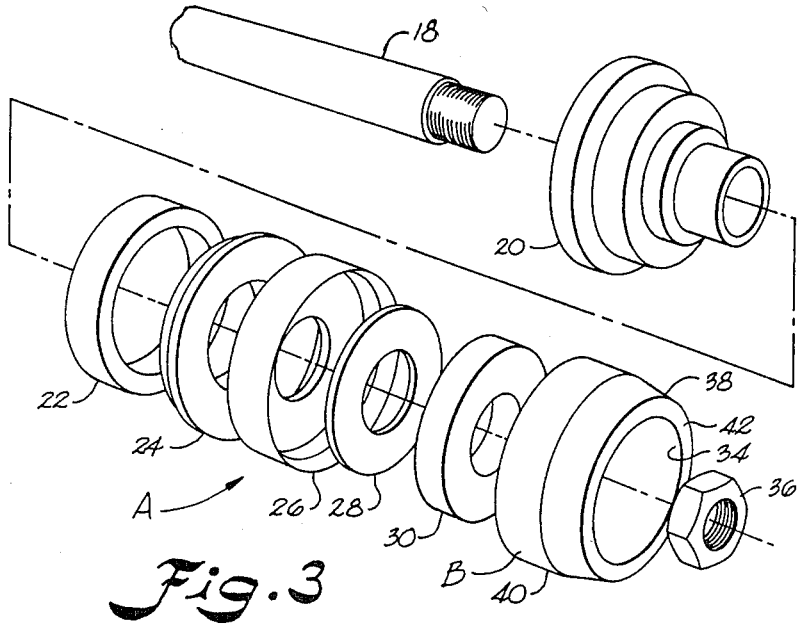
FIG. 3 is a perspsective view with parts separated illustrating the piston assembly of the pump of FIG. 2.

Referring to FIG. 2, it can be seen within compression chamber 44 there is a head plate 46 having a nose **46*a* which facilitates flow of viscous material through the pump chamber from an inlet 48 to an outlet 50. Inlet 48 includes an inlet ball 48*a* seated on ball valve seat 48*b*. It will be noted that the passage or throat 48*d* of inlet valve seat 48*b* is unrestricted. A similar valve 50*a* seats on a ball valve seat 50*b* in outlet 50. A ball valve limit pin limits the upward limit of the inlet ball 48*a*. An auger type feed 53 typically feeds material to inlet 48**.

A contoured edge 38 of piston B is contoured and beveled to allow piston B to occupy compression chamber 44 in an extended manner, as can best be seen in FIG. 2 by allowing sufficient clearance between piston B and ball valve **48*a*. Beveled surface 38 further exerts an upward component of force on plaster material pumped through chamber 44**.

Referring now to FIGS. 5, 6, and 6A, the prior art arrangement as found in the prior art TM 30 Essick pump is illustrated. In this arrnagement, like parts will be denoted by like numerals. Accordingly, a piston assembly includes push rod 18 back plate 20, felt ring 22, and brass ring 24. There is a leather cup member 54 carried next to brass ring 24. Intermediate plate 28 and rubber ring 30 are located within leather cup 54. There is a piston 56 carried on the end of piston assembly C which is secured thereto by nut 36 fully exposed to the compression chamber 44.

The Essick pump includes an inlet valve seat 58 having upwardly sloping walls 58a which form the valve seat on which the ball 60 is seated. A ball limit pin **52*a* extends into the compression chamber about 5/6 inch more than in the case of pin 52 of the present invention, thus limiting the stroke of the piston. A ball limit pin 52*a* extends into he compression chamber about five to six inches more than in the case of pin 52 of the present invention, thus limiting the stroke of the piston. There is a retractor pin 62 in the throat of inlet valve seat 58 which allows the valve seat to be extracted from the pump by a tool. Because the valve seat extractor pin is present, the throat is divided into a pair of narrow slots 64. These slots provide restricted passage of viscous material. While the aforedescribed valve seat may be sufficient for the pumping pressures and capacity of the Essick pump, it is not suitable for high production and efficient pump use. Outlet seat 66 includes similar sloping walls 66*a* on which a ball 68 rests. The outlet valve does not require a retractor pin and thus the throat of the valve 66 is unrestricted. There is an upper ball stop pin 70** in both the conventional Essick pump and in the improved pump of the present invention.

As can best be seen by comparing FIGS. 2A and 3 to FIGS. 5 and 6A, the improved pump features of the present invention, which may be provided in an adapter kit, include an unrestricted inlet valve seat **48*b*** which not only is unrestricted, but has been enlarged relative to the prior art valve passage. This allows for increased intake of viscous material on the suction stroke due to the increased operational pressures of the instant invention.

The leather cup 54 of the prior art pump has been replaced with a cup member 26 constructed of a polymeric material such as polyurethane. The leather cup 54 has been found to wear unevenly. Due to the soft leather material, the leading edges of the cup have been found to curl in and not seal properly against the piston cylinder wall **19*a* thus resulting in low compression and suction and pump pressure. Further, the uneven sealing allows the piston to wobble which is further compounded by the heavy piston 56** which is of a metal construction. With the wobbling of the plate and piston assembly, the entire piston assembly becomes out of line quickly leading to leakage and low compression. The result is an increase in the wear between the piston assembly and the cylinder wall.

In accordance with the instant invention, a light weight piston B is provided which extends into the compression chamber a considerable distance beyond that of the prior art piston 56 providing increased pumping capacity. This is due to the construction and contour of beveled edge 38 of piston B. Further, by constructing the piston cup 26 from a stable more rigid and sealing material, and due to the light weight nature and construction of piston B, the entire piston assembly has been found to travel in a true manner through the center of the cylinder with maintained sealing. In this manner, wobbling of the piston assembly and unnecessary wear of the piston assembly parts has been considerably reduced. These improved characteristics plus the extension of piston B into the compression chamber have increased the pumping capacity of the pump considerably by increased compression and suction.

Figure 4:
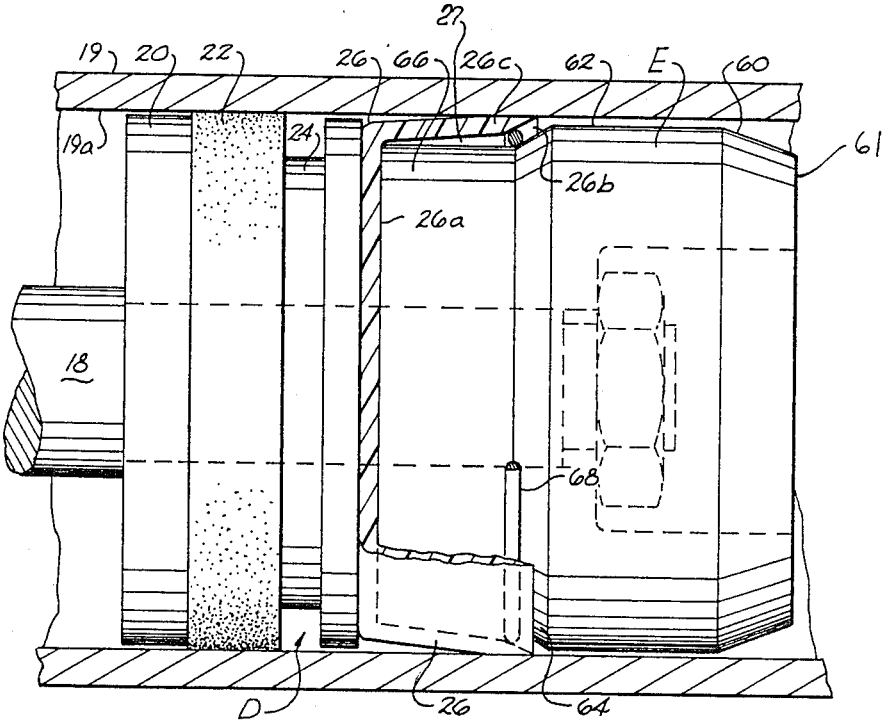
FIG. 4 is a sectional view of a pump cylinder illustrating a piston assembly constructed in accordance with another embodiment of the invention.

Another embodiment of the invention is shown in FIG. 4 wherein a piston assembly denoted generally as D is provided having a unitary piston E. In the embodiment of FIG. 4, intermediate ring 28 and rubber ring 30 are eliminated. The piston E is constructed from lightweight polymeric material and has an extended forward beveled edge 60, piston face 61, cylindrical surface 62, a rear beveled surface 64 and a reduced cylindrical neck 66. The neck of piston E fits within cup member 26 and abuts a cylindrical base 26*a* thereof. There is an O-ring 68 fitted about rear beveled surface 64. O-ring 68 abuts against a knife edge 26*b* of cup member 26. Thus, the space between piston E and cup member 26 is sealed against passage of material as could otherwise excessively wedge cup wall 26*c* of cup member 26 outwardly against the interior cylinder wall 19*a* to cause binding. The O-ring 68 may be replaced with progressively larger diameter O-rings in the event that wear between cup member 26 and the interior of the cylinder wall occurs. This means the cup member may be adjusted to accommodate wear without losing pressure. By providing a unitary assembly for piston E, and by eliminating rubber ring 30 there is no need to torque the piston assembly D together as occurs in the prior art. In the prior art, as can best be seen in FIG. 6, it is necessary to torque nut 36 against piston 56 to properly compress ring 30 and cause ring 30 to be radially expanded and force outwardly the circumferential wall of the leather cup 54. If too much torque is applied in properly setting the prior Essick pump sealing members, the seal will wear out prematurely. If not enough torque is applied to the nut and piston assembly, leakage will occur. These disadvantages are eliminated in accordance with one embodiment of FIG. 4.

Referring to FIG. 4, the improved cup member 26 can be seen in more detail. Outer cylindrical wall 26*c* of cup member 26 tapers outwardly from base 26*a* by about five to ten degrees with respect to the longitudinal axis of the cylinder. Ten degrees taper is preferred. This provides a self-sealing cup member. The cylindrical base 26*a* of cup member 26 is slightly out of contact with cylinder wall 19*a*. Outwardly tapering cup wall 26*c* seals against the cylinder wall over a portion of about one-half thereof. The reason that the lower wall 26*c* of the base of the rubber cup does not contact the cylinder wall is because this area acts as a rigid disc and would not allow the flexible wall 26 to seal properly on the cylinder wall since it would not be able to flex if the rigid base contacted wall 19*a*.

A wedge space 27 is formed between piston E and the circumferential wall 26*c* of piston cup 26 occupied by O-ring 28. As the outside of wall 26*c* wears, O-ring 28 may be progressively replaced with O-rings of larger cross-sectional thickness (diameter) to adjust and urge the wall outwardly generally with a constant force to automatically compensate for wear.

It has been found that the modifications of the Essick pump as shown in FIG. 2 which includes the piston B, new valve structure 48, and polyurethane cup member 26 increase the output of the conventional Essick pump by at least one hundred twenty-five percent (125%). That is, the production of the Essick pump is increased from sixty-six bags per hour to at least one hundred bags per hour at full throttle and high gear. Further, it has been found that seventy-seven bags in low gear and two-thirds throttle can be achieved which is about the maximum amount of material which can be handled on a single line, at a much lower power consumption than the Essick pump. While the conventional Essick pump typically requires a down time and maintenance every three weeks, a pump improved according to the instant invention found to operate for periods of three months or more without any down time or maintenance needs.

Figure 7:
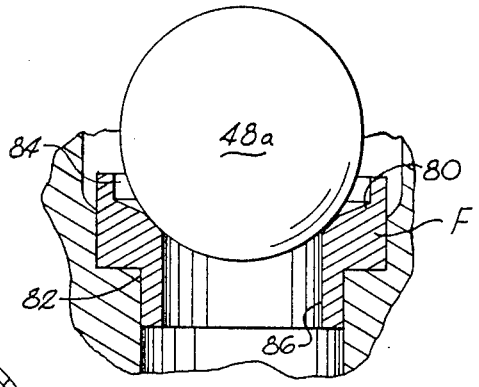
FIG. 7 illustrates an inlet valve seat in accordance with the method and construction of the present invention.
Figure 7A:
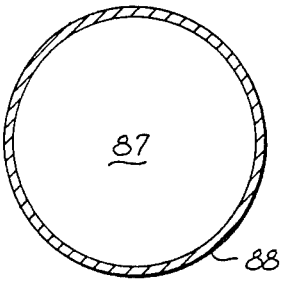
FIG. 7*a* is a sectional view of an improved ball valve in accordance with the present invention.

Referring now to FIG. 7, an inlet valve seat F is shown in modified form as compared to inlet valve seat 48*b* in FIG. 2. The valve seat F includes a funnel portion 80, and a chamfered seat 82 for the ball element 48*a*. The chamfered edge 82 is a thirty-eight to forty degree surface whereas the beveled seat surface of the valve seat shown in FIG. 2 is forty-five degrees. In the modified valve seat F, the ball element 48*a* is a two and one eighth inch ball and rests approximately in the middle of chamfered surface 82 rather than on an edge in the prior art. In this manner, a clearance space 84 is provided in which the ball may seat properly. When beaded fireproofing materials are utilized, it is possible for a bead to become wedged in the conventional valve seat causing the ball not to seat properly. In valve seat F, the beads will be forced either down passage 86 or into space 84 by the ball. An improved ball 87 is shown in FIG. 7A having a coating layer 88 of a suitable rubber or plastic material to reduce wear between the ball and valve seat.

Figure 8:
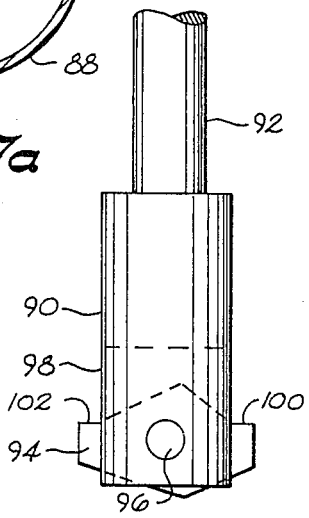
FIG. 8 illustrates a valve seat extracting tool for extracting the valve seats shown in FIG. 7.
Figure 9:
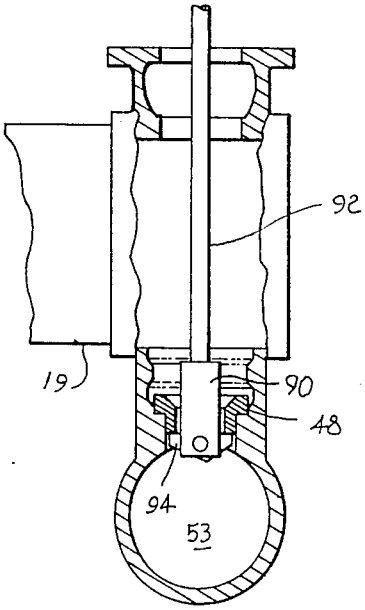
FIG. 9 is a sectional view illustrating the valve seat extractor in position for extracting the inlet valve seat.

Referring now to FIG. 8, a valve seat extractor 90 is illustrated which is threadably attached to a pull rod 92. Pull rod 92 may be a conventional Essick extractor tool handle. The extractor 90 constructed in accordance with the present invention includes an unsymmetrical tool 94 pivotally attached at 96 to a housing 98. The tool 94 includes a pair of valve seat engaging ledges 100 and 102. One end of the tool 100 or 102 may be made slightly heavier. The tool may be pivoted inside the holder 98 within the heavy end up. When the tool is inserted below the valve seat, a slight shaking of the tool will cause the tool 94 to pivot so that both ledges 100 and 102 are brought up underneath the valve seat as can best be seen in FIG. 9. The valve seat may then be extracted in a conventional manner.

Figure 10:
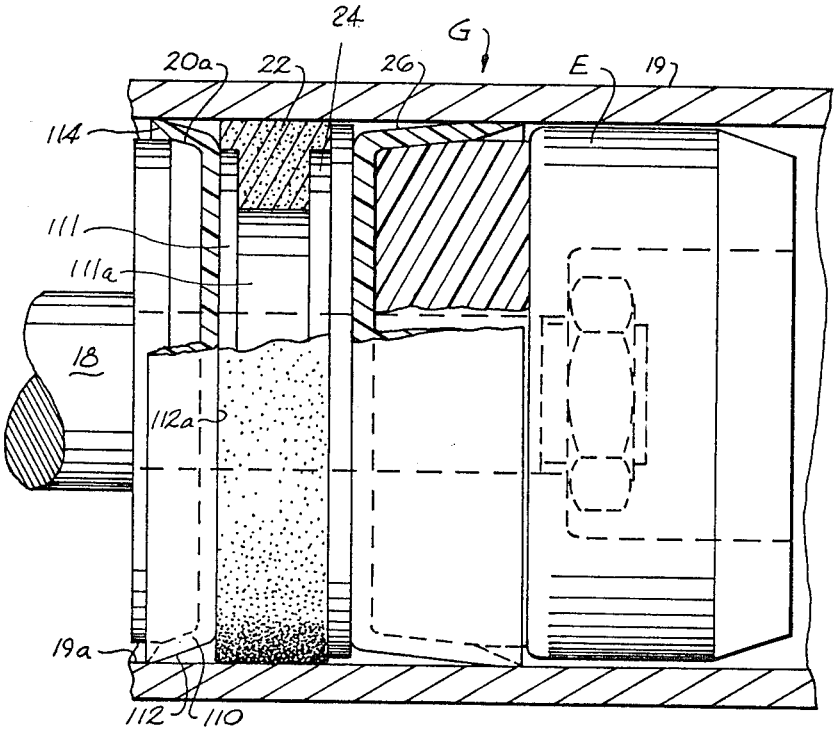
FIG. 10 is a sectional view of an alternate embodiment of a piston assembly constructed according to the invention.

As can best be seen in FIG. 10, a rearwardly disposed sealing cup 110 is illustrated as included in a piston assembly, denoted generally as G, between back plate 20 and felt ring 22. For this purpose, plate 20 may be provided with a chamfered edge at 20*a*. There is a plate member 111 with a hub 111a disposed between cup 110 and brass ring 24 so felt ring 22 is held in place without undue compression. Sealing cup 110 is constructed from a good sealing polymeric material and includes a circumferential wall 112 which tapers outwardly from a cylindrical base 12*a* at about five to ten degrees to seal against piston cylinder wall 19*a*. About one-half to one-third of cup wall 112 contacts the cylinder wall. A knife edge 114 is formed about the interior peripherial edge of cup wall 112. On the suction stroke, sealing cup 110 seals against the blow by of air to the compression side of piston assembly G. This reduces air spaces in the compression chamber and increases the compression stroke. Sealing cup 110 may be incorporated in the embodiment of FIG. 2 also.

While a preferred embodiment of the invention has been described using specific terms, such description is for illustrative purposes only, and it is to be understood that changes and variations may be made without departing from the spirit or scope of the following claims.

What is claimed is:

1. A high performance pump for pumping fireproofing and the like viscous materials comprising:

a compression chamber having an inlet and an outlet;

a piston cylinder disposed in fluid communication with said compression chamber having a piston cylinder wall;

said inlet and outlet of said compression chamber including an inlet passage and an outlet passage extending generally transverse to said piston cylinder;

a piston assembly carried within said piston cylinder which includes;

a push rod, a piston carried by a forward distal end of said push rod having a piston face extending generally to said transverse inlet and outlet passages of said compression chamber and adjacent a distal wall of said compression chamber on the compression stroke, said piston having a cylindrical body, and a contoured beveled surface tapering from said cylindrical body to said piston face to provide clearance between said piston and said inlet on said compression stroke, a piston cup carried by said push rod having a circumferential cup wall engaging said piston cylinder wall sealing against increased compression from said extended piston; and means carried by said push rod for urging said circumferential cup wall of said piston cup outwardly in sealing contact with said piston cylinder wall.

2. The apparatus of claim 1 including a piston cup having a piston cup wall which tapers outwardly from about five to ten degrees from the cylindrical base of said piston cup.

3. The apparatus of claim 1 including an inlet valve seat having a passage which is unrestricted.

4. The apparatus of claim 1 including an inlet valve seat in said inlet of said compression chamber having a circular funnel surface which tapers downwardly to a chamfered valve seat in a manner that a funnel space is created about said inlet ball valve when seated on said chamfered seat to prevent material from being trapped between said inlet ball valve and valve seat when said ball valve is seated.

5. The apparatus of claim 1 which includes a sealing cup included in said piston assembly facing in an opposing direction from said piston cup having a cylindrical wall which engages said interior wall of said piston cylinder to seal against the blow by of air on the suction stroke of said piston assembly.

6. The apparatus of claim 1 wherein said extended piston is provided with a reduced neck portion having an outer diameter less than the outer diameter of said cylindrical portion and less than an inner diameter of said piston cup wall.

7. The apparatus of claim 6 including means interconnecting said extended piston and said piston cup wall urging said piston cup wall in sealing contact engagement with said piston cylinder.

8. The apparatus of claim 6 wherein said neck portion of said piston fits within the interior of said piston cup wall and abuts the cylindrical base of said cylindrical cup wall.

9. The apparatus of claim 8 including an O-ring between said extended piston cup wall and said piston urging said piston cup wall into sealing contact with said piston cylinder wall.

10. The apparatus of claim 9 including a wedge space between an interior side of said piston cup wall and said extended piston and placing said O-ring inside of said wedge space in a manner that as the outer wall of said piston cup becomes worn the O-ring rides inwardly into the crevice of said wedge space to maintain sealing contact of said exterior wall of said piston cup.

11. A high performance pump for pumping fireproofing and the like viscous materials comprising:

a compression chamber having an inlet and an outlet;

a piston cylinder disposed in fluid communication with said compression chamber, said piston cylinder having a piston cylinder wall;

said inlet and outlet of said compression chamber including an inlet passage and an outlet passage extending generally transverse to said piston cylinder;

a piston assembly carried within said piston cylinder which includes;

a push rod, a piston carried by a forward distal end of said push rod having a piston face extending generally to said transverse inlet and outlet passages of said compression chamber and adjacent a distal wall of said compression chamber on the compression stroke, said piston having a cylindrical body, and a contoured beveled surface tapering from said cylindrical body to said piston face to provide clearance between said piston and said inlet on said compression stroke, a piston neck formed rearwardly of said cylindrical body having a diameter less than the diameter of said cylindrical body, a piston cup carried by said push rod having a circumferential wall partially surrounding said piston neck and a base in direct engagement with said piston neck, and means interconnecting said piston and said piston cup urging said circumferential wall of said piston cup outwardly in sealing contact with said piston cylinder wall.

12. The apparatus of claim 11 wherein said interconnecting means comprises an O-ring carried between said circumferential wall of said piston cup and said piston urging said circumferential wall outwardly along a portion thereof in sealing contact against said piston cylinder wall.

13. The apparatus of claim 12 wherein said base of said piston cup has a outside diameter which is less than the inside diameter of said piston cylinder and tapers outwardly in a manner that only a portion of said circumferential wall of said piston cup is in sealing contact with said piston cylinder wall.

14. The apparatus of claim 11 wherein said pump comprises an inlet valve seat which has an unrestricted valve passage.

15. The apparatus of claim 14 comprising a valve seat pulling device which comprises an unsymmetrically weighted body having opposing valve seat engaging ledges, said weighted body pivoting to a vertical position for insertion through said inlet valve seat and thereafter pivoting to a horizontal position wherein said ledges engage said valve seat for removal.

16. An adapter kit for modifying and improving the performance of an existing pump for pumping fireproofing and other viscous materials, wherein said pump is of the type having a compression chamber with an inlet and an outlet; an inlet valve seat carried in said inlet having an inlet ball valve seated thereon; an inlet ball limit pin included in said inlet for limiting the upper axial movement of said inlet ball valve; an outlet valve carried in said outlet of said compression chamber; a piston cylinder in fluid communication with said compression chamber; said inlet and outlet being generally transverse to said piston cylinder; a piston assembly carried in said piston cylinder for reciprocating compression and suction strokes; wherein said adapter kit comprises:

an inlet valve seat having an unrestricted valve passage generally transverse to said piston cylinder;

an extended piston for said piston assembly having a cylindrical body with an axial extent which extends into said compression chamber adjacent said transverse inlet valve passage during the compression stroke but terminating short of said inlet valve limit pin, said extended piston being received on a push rod of said piston assembly with a fastener for affixing said extended piston to said push rod to be concealed within the cyindrical body of said extended piston except for a forward opening cavity formed in the piston face of said extended piston adjacent the interior of said compression chamber, a beveled surface extending from said cylindrical body to said piston face which provides clearance between said piston and said inlet ball valve; and a polymeric piston cup for said piston assembly to be carried by said piston rod behind said extended piston.

17. The adapter kit of claim 30 wherein said polymeric piston cup includes a circumferential wall which tapers outwardly towards said compression chamber in sealing contact over a portion thereof against said piston cylinder wall.

18. The adapter kit of claim 30 further comprising a sealing cup included in said piston assembly which has a circumferential wall terminating in a free edge facing in an opposing direction to the circumferential wall of said piston cup for sealing against blow by of air on the suction stroke of said piston assembly.

19. The adapter kit of claim 30 wherein said extended piston comprises a reduced piston neck formed rearwardly of said piston head having an outside diameter which is less than the outside diameter of said cylindrical body, said reduced piston neck being received within the circumferential wall of said piston cup.

20. The adapter kit of claim 19 including means for interconnecting said extended piston and said piston cup in the form of an O-ring positioned between said extended piston and said piston cup wall urging said circumferential wall outwardly in sealing contact with said piston cylinder wall.

21. The adapter kit of claim 20 including a wedge space defined between said outwardly tapering piston cup wall and said extended piston, said O-ring being carried in said wedge space to compensate for wear in an automatic manner.

22. A method of increasing the capacity of a pump for pumping viscous materials such as fireproofing materials, said pump having a compression chamber which has a transverse inlet and outlet, said inlet including an inlet ball valve seated on an inlet ball valve seat and an inlet ball limit pin for limiting the upward axial movement of said inlet ball valve in said inlet, said outlet including an outlet ball valve seated on an outlet ball valve seat; a piston cylinder disposed in fluid communication with said compression chamber generally transverse to said inlet and outlet; a piston assembly carried in said piston cylinder having a piston driven in reciprocating suction and compression strokes, said method comprising:

increasing the compression of said pump in said compression chamber by using a piston which has a piston face extending to a position adjacent said inlet ball limit pin at the end of the pump compression stroke, said piston having a cylindrical surface adapted to fit within said piston cylinder extending generally parallel to the interior wall of said piston cylinder and a beveled surface extending from said cylindrical surface to said piston face which provides clearance between said piston and said inlet ball valve at the end of said compression stroke so that said piston may extend into said compression chamber adjacent said transverse inlet and outlet; and sealing said piston cylinder with a piston cup constructed from a polymeric material having a cylindrical base with an outer diameter generally less than the inner diameter of said piston cylinder and a cylindrical wall extending from said cylindrical base having an outer diameter which is generally greater than the outer diameter of said cylindrical base providing reduced friction and effectively sealing said piston cylinder wall against said higher compression.

23. The method of claim 22 wherein said piston is in a form having a piston neck with an outside diameter less than the inside diameter of said piston cup for nesting therein.

24. The method of claim 23 including an O-ring positioned between said extended piston and said piston cup wall urging said portion of said piston cup wall outwardly in sealing contact against said piston cylinder wall.

* * * * *